US007634176B2

(12) United States Patent
You

(10) Patent No.: US 7,634,176 B2
(45) Date of Patent: Dec. 15, 2009

(54) DEVICE AND METHOD FOR FORMING WATER VAPOR

(76) Inventor: Tuming You, 285 Jia He Road, No. 2102, Xiamen (CN)

( * ) Notice: Subject to any disclaimer, the term of this patent is extended or adjusted under 35 U.S.C. 154(b) by 436 days.

(21) Appl. No.: 11/707,790

(22) Filed: Feb. 15, 2007

(65) Prior Publication Data

US 2008/0001000 A1 Jan. 3, 2008

(30) Foreign Application Priority Data

Jun. 30, 2006 (CN) ..... 2006 1 0045326

(51) Int. Cl.
*A01G 13/06* (2006.01)

(52) U.S. Cl. ..... 392/386; 392/398; 392/394

(58) Field of Classification Search ..... None
See application file for complete search history.

(56) References Cited

U.S. PATENT DOCUMENTS

2008/0047172 A1 2/2008 You

OTHER PUBLICATIONS

U.S. Appl. No. 11/651,903, filed Jan. 9, 2007, Tuming You.
U.S. Appl. No. 11/703,044, filed Feb. 5, 2007, Tuming You.
U.S. Appl. No. 11/938,731, filed Nov. 12, 2007, Tuming You.

*Primary Examiner*—Thor S Campbell
(74) *Attorney, Agent, or Firm*—Squire Sanders & Dempsey, LLP

(57) ABSTRACT

A device and method are provided for forming vapor mainly utilizing the atomization device to form low temperature water vapor, and then using an adjustable heating unit to warm the low temperature water vapor, or mixing some high temperature steam to get needed temperature water vapor. The invention uses the atomization device which mainly was used to humidify the air to form the needed water vapor in beauty, hairdressing, or health care so as to adjust the temperature of water vapor to solve the problems which are existing in the fields of beauty, hairdressing, health care, where the high temperature steam scalds a person more easily, and the temperature is difficult to control. The present invention makes the application of the steam in these fields more free, common and popular.

11 Claims, 8 Drawing Sheets

DEVICE AND METHOD FOR FORMING WATER VAPOR

CROSS-REFERENCE TO RELATED APPLICATION

This application claims priority to Chinese patent application No. 200610045326.1 filed on Jun. 30, 2006, the teachings of which are incorporated herein by reference in their entirety.

FIELD OF THE INVENTION

The invention is related to a device for forming vapor, specifically a device and method for forming water vapor which can be used in beauty salons, hairdressing, or health care.

BACKGROUND OF THE INVENTION

Steam is often used in the field of beauty salon, hairdressing, health care. For example, in hair curling, we first use different kinds of tools to curl the hair to desired style, then use steam to braise the hair to immobilize the style. As another example of treating hair, we first lay cream on to the hair, then use steam to braise the hair, making it easy for the hair treatment elixir to be absorbed. Also, for example, in vapor bath, we let the body in the steam, which supplies water to our body, making the body perspire and vent wastes; after the steam bath, the lactic acid in the body dissipates through the blood circulation, making body and mind very relaxed, and causing the body to be warm and the hard-shelled muscle to relax so as to more easily receive muscle shrinking treatment without the discomfort from massages of handcraft or machine. At the same time, the steam bath makes it easier to absorb the nourishment and the medicament, and beautifying skin becomes more possible.

The applicant has applied for a patent which is called "a steam massage" to the Chinese Nation Knowledge Property bureau, the application number is 200520125747.6. Its structure includes a handle and massage rollers, the massage rollers are set on the top of the handle and can be rotated, the massage rollers are located on the rotating shaft which is set on the upper end of the handle and can be rotated. The massage rollers comprise many steam ejecting holes, there is a steam chamber in the rotating shaft, and the steam chamber comprises a steam outlet which is super-imposed and connected with some steam holes on the massage rollers by turns along with the rotating of the massage rollers. There is a water tank inside of the handle, the water tank is connected with the rotating shaft of the said massage rollers by a steam pipe, and a electric heating element is set on the lower side of water tank. The electric heating element is connected with the power cord outside of the handle. The massage rollers of the steam massage can eject steam, and can let people massage their skin locally and do local skin steam bath to get better massage efficiency.

There is the same drawback in all the said steam used by people. The problem is that the steam is obtained by heating water, the temperature usually exceeds 100° C., if it touches the skin closely it will scald the skin, if the distance is far, it will not be efficient, so the controlling of the temperature is a difficult problem.

SUMMARY OF THE INVENTION

The invention provides a device for forming water vapor, the main purpose is to solve the drawback in the existing technology, namely, that the device for forming vapor directly uses water to be heated until it boils to generate the steam, and the formed steam temperature usually exceeds 100° C. and can easily scald people's skin, and the temperature is difficult to be controlled in the fields of beauty salon, hairdressing, or health care.

The present invention is based on the following principle: using the atomization device to make the water become low temperature vapor and then mixing the low temperature vapor with high temperature steam, or heating the low temperature vapor so as to get desired temperature vapor.

Described below are two technological solutions provided by the present invention:

Solution One:

A device for forming water vapor comprising: an atomization device comprising: an atomizing chamber comprising a low temperature vapor outlet, an atomizer which is located in the atomizing chamber to make the water become to be low temperature vapor, and an impeller driving the low temperature vapor of the atomizing chamber into the outlet; a high temperature steam forming device for producing high temperature steam comprising a high temperature steam outlet; a steam outlet pipe, comprising: two steam intakes which are respectively connected with the low temperature vapor outlet of the atomizing chamber and high temperature steam outlet of the high temperature steam forming device, and a mixing steam outlet; and a water tank for supplying needed water for the atomization device and the high temperature steam forming device.

The said device for forming water vapor, the water tank comprising: a main water tank located on the upper side, an assistant water tank located on the lower side, a water inlet valve between the main water tank and the assistant water tank, and a wind guiding shell comprising a wind blowing mouth, the atomizing chamber is set on one side of and connected with the assistant; the low temperature steam outlet is set on the top of the atomizing chamber; the wind guiding shell is set outside of the impeller, the wind blowing mouth of the wind guiding shell facing the bottom of the low temperature steam outlet; and the water inlet pipe of the high temperature steam forming device is connected with the bottom of the assistant water tank where a water volume adjusting valve being set on the connecting area and the water volume adjusting valve comprises a knob which is adjustable outside.

The said device for forming water vapor, the water inlet valve includes a cylinder valve body which is protruding into the assistant water tank from the bottom of the main water tank, the bottom edge of the valve comprises a void, the position of the void being lower than the position of the wind blowing mouth; the valve comprises a valve hole in the middle of the valve body; in the valve hole there is a valve stopper which tightly fills the valve hole from the bottom to the top; the stopper comprises an up-extending valve stick on the top of the stopper, the valve stick comprising a spring causing the valve stick to move up to tightly fill the valve hole; and the main water tank comprises a water inlet on the top of the main water tank, the water inlet comprises a knob cover, the bottom of which comprises a connecting rod which extends into the main water tank and is capable of pushing the valve stick downward so as to cause the valve stopper to pull away from the valve hole.

The said device for forming water vapor, the mixing steam outlet of the steam guiding output pipe is connected with a hollow ring by a steam pipe, on the bottom of the hollow ring there are many steam ejecting holes along the circumference, and the hollow ring is set on a rack.

There is a heating unit located on the jointing position of the said steam pipe and the hollow ring, the heating unit comprises: a metal pipe tie-in comprising two ends, the two ends being connected with the steam pipe, a PTC heating element set on the outside wall of the metal pipe tie-in, and a thermostat which is connected with the PTC heating element.

Solution Two:

A device for forming water vapor that includes: an atomization device comprising: an atomizing chamber, an atomizer located in the atomizing chamber for causing water to become to low temperature vapor, and an impeller for driving the low temperature vapor in the atomizing chamber to flow toward outlet; a water tank for supplying water to the atomization device; an output part comprising a handling part, comprising: a steam inlet on the handling part, at least one steam outlet, and a pipe connecting the steam inlet and the at least one steam outlet, the pipe comprising an adjustable temperature heating unit on the pipe; and a steam pipe which connects the steam inlet on the handling part with the low temperature steam outlet of the atomizing chamber.

The said device for forming water vapor, the output part is a handling part, the handling part comprising a head and a handle in a single body, the head comprising a plurality of massage rollers which are paratacticly set on the head, the handling part comprises a plurality of steam outlets which are respectively set between the corresponding massage rollers, the steam inlet on the handling part is set on the end of the handle; and the heating element is set inside the handle, the heating element comprising: a metal pipe tie-in comprising two ends, the two ends being connected with the steam pipe, a PTC heating element set on the outside wall of the metal pipe tie-in, and a thermostat which is connected with the PTC heating element.

The said device for forming water vapor, the atomizing chamber is located on the lower side of the water tank, the atomizing chamber being connected with outside atmosphere, the water tank is sealed, there is a water inlet valve between the water tank and the atomizing chamber, the water inlet valve including a cylinder valve body which is extending to the atomizing chamber where the inside of the valve body comprises a channel which connects the water tank with the atomizing chamber, and where the lower end of the valve body comprises a void, the atomizing chamber is connected with steam outlet by a steam channel, the position of the inlet of the steam channel being higher than the void of the water inlet valve, on the outside of the impeller there is a wind guiding shell, the wind guiding shell comprising a wind blowing mouth which is connected with the atomizing chamber and is near the inlet of the steam channel.

The said device for forming water vapor, the output part is a massage belt, on the inside surface of which there are several massage protruding points and a plurality of steam outlets which are respectively set between the corresponding massage protruding points, the heating unit is set on outside surface of the massage belt, the heating unit comprising: a metal pipe tie-in, the two ends of which are connected with the steam pipe, a PTC heating element which is set on the outside wall of the metal pipe tie-in, and a thermostat which is connected with the PTC heating element.

The atomization device and the water tank are a single body structure which is connected with the output part by steam pipe.

The first embodiment includes passing through mixing the low temperature vapor formed by atomization device and high temperature vapor formed by the device for forming high temperature vapor to generate the desired temperature vapor; the second embodiment is passing through heating the low temperature vapor made from the atomization device to generate the desired temperature vapor. The same feature of the two projects is to utilize the atomization device to form low temperature vapor, then adjustablely heating the low temperature vapor to get the desired temperature vapor.

Summarizing all the above descriptions one can see that the present invention has the following advantages: The invention innovatively uses the atomization device which was mainly used to humidify air to form the needed water vapor in beauty salon, hairdressing, health care, so as to adjust the temperature of the formed water vapor, solving the problems which arise in the fields of beauty salon, hairdressing, or health care where the problems are that the high temperature steam made from relative devices can easily scald people, the temperature being difficult to control. The invention can also make the application of the vapor in these fields more free, unlimited and popular.

DESCRIPTION OF EXEMPLARY EMBODIMENTS OF THE INVENTION

The following is discussed by referring to FIG. 1 to FIG. 4 to explain the first embodiment of the present invention.

Figure 1:
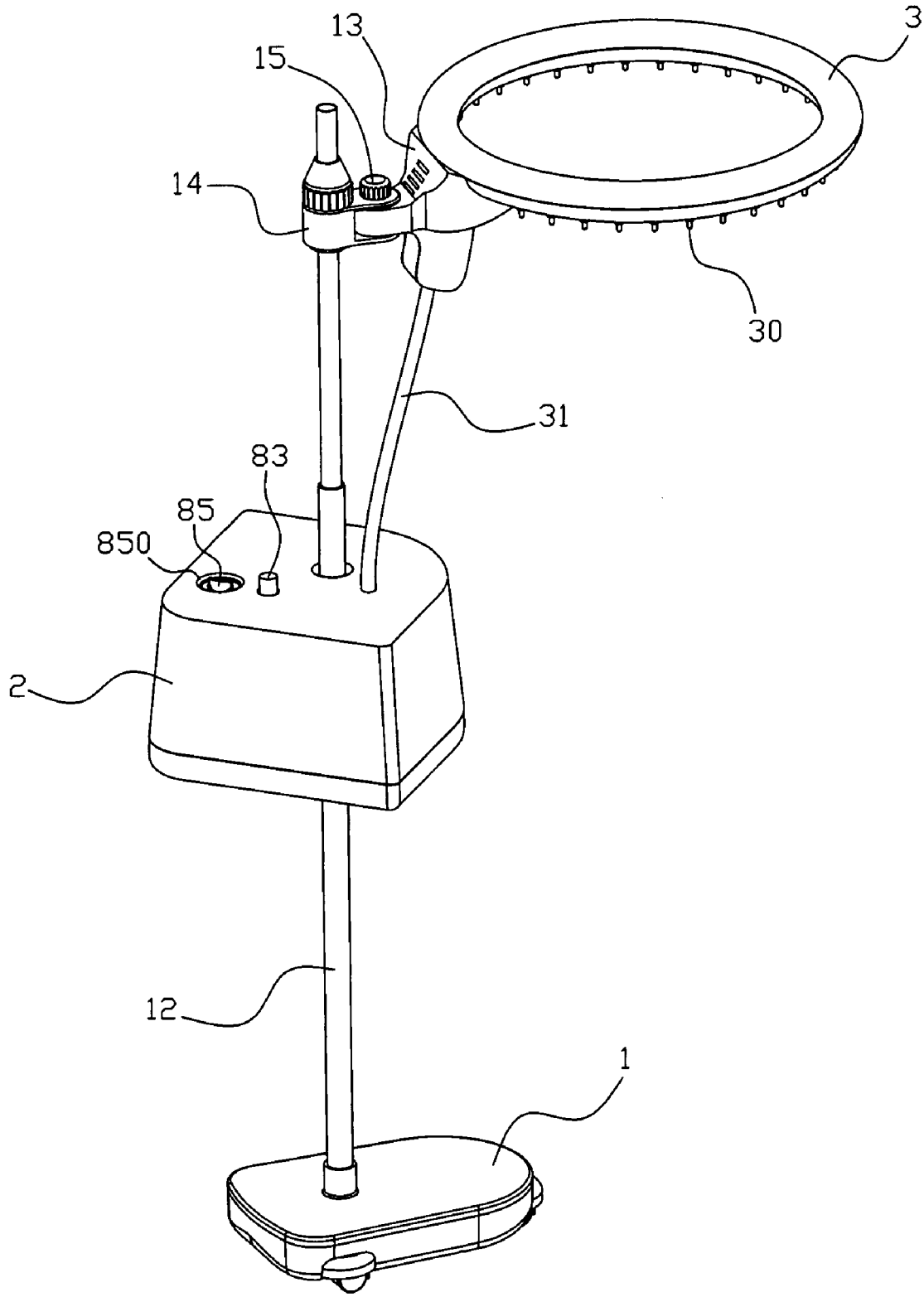
FIG. 1 is the stereogram of the first embodiment of the present invention.

The embodiment supplies a hair treatment elixir machine which adopts the invention device for forming adjustable temperature vapor, referring to FIG. 1, the hair treatment elixir machine including a base 1, an up-extending supporting stick 12 which is vertical to and set on the base 1, a connecting base 14 which is set on the top of the supporting stick 12, a connector 13 which is engaged with the connecting base 14 by a screw 15 which is located on vertical direction, a steam ejecting ring 3 which is set on the connector 13, the device 2 for forming vapor which is located on the middle of the supporting stick 12. On the top of the steam forming device 2 there is a water inlet 850, on the water inlet 850 there a knob cover 85, the steam forming device 2 is connected with the said steam ejecting ring 3 by a steam pipe 31. The steam forming device 2 also comprises a knob 83 to regulate the temperature of the output steam.

Figure 2:
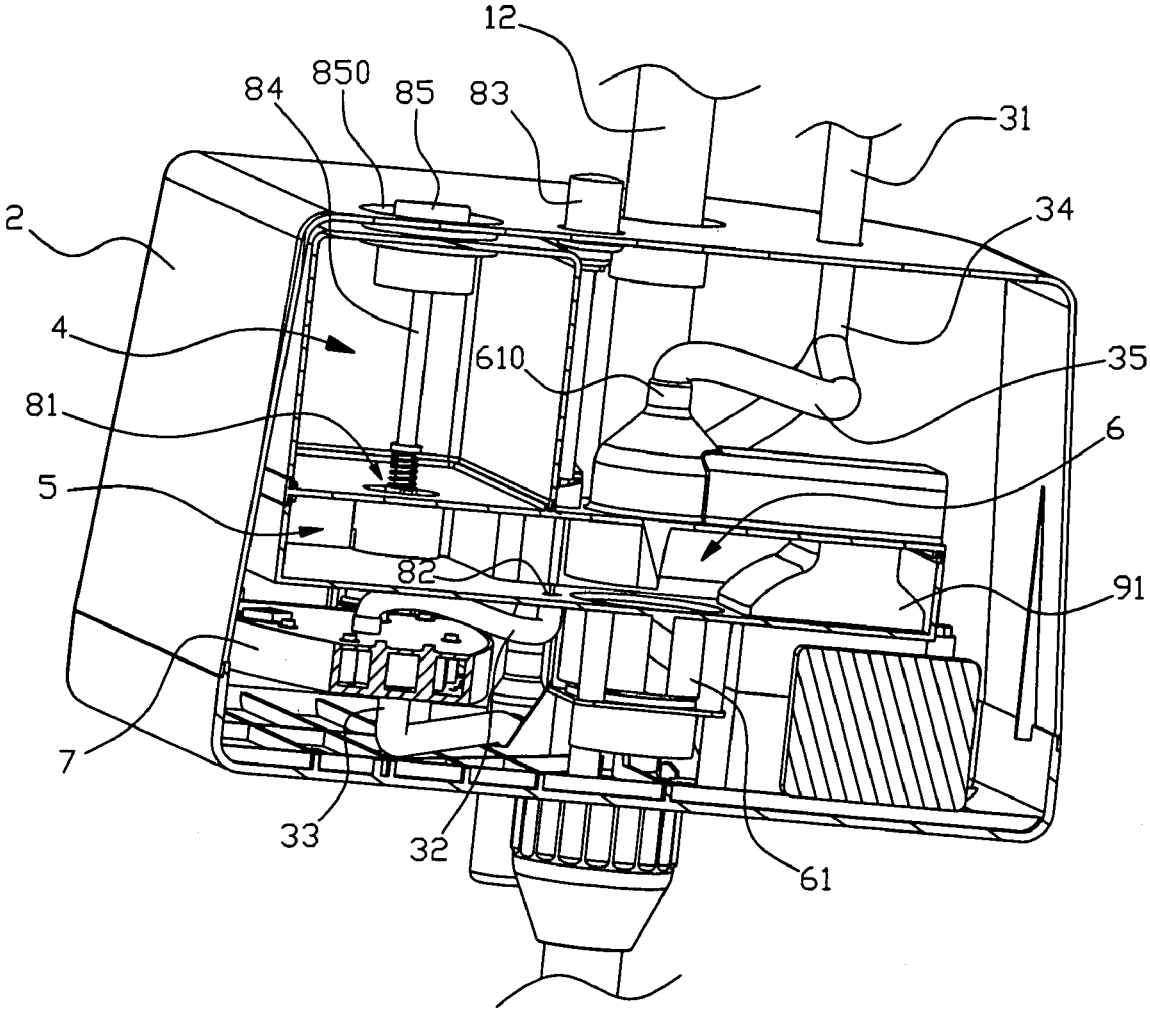
FIG. 2 is a local sectional view of the first embodiment of the present invention.
Figure 3:
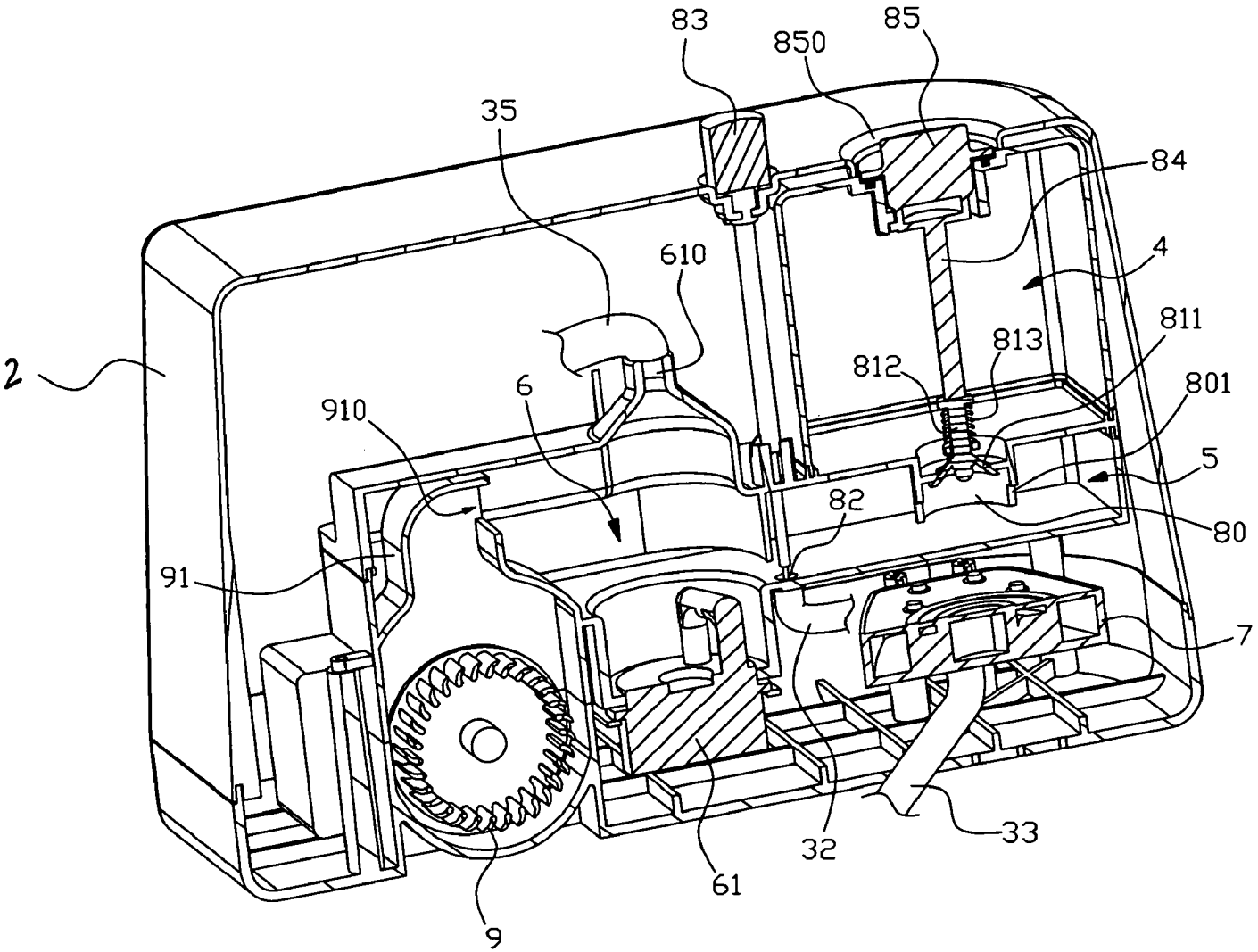
FIG. 3 is a another local sectional view of the first embodiment of the present invention.

Referring to FIG. 2 and FIG. 3, the steam forming device 2 is sectional cut from two different positions to show its inside structure. The steam forming device 2 includes a main water tank 4, on the lower side of the main water tank 4 there is a assistant water tank 5, between the main water tank 4 and assistant water tank 5 there is a water inlet valve 81 which can control the water of main water tank 4 flowing into assistant water tank 5 and can also control the water level of the assistant water tank 5. There is a atomizing chamber 6 on one side of the assistant water tank 5 there is a atomizing chamber 6 which is connected with the assistant water tank 5, the upper side of the atomizing chamber 6 forms a low temperature steam outlet 610 which's inside wall is cone-shaped. In the atomizing chamber 6 there is a atomizer 61 which can make the water of the atomizing chamber 6 become to the low temperature vapor. On one side of the atomizing chamber 6 there is a impeller 9 which is drived by a motor which is not shown in the drawing. Outside of the impeller 9 there is a wind guiding shell 91 comprising a wind blowing mouth 910 facing the bottom of the low temperature steam outlet 610.

On the lower side of the assistant water tank 5 there is a high temperature steam formed device 7 which already adopted the steam forming device which is commonly used in electric steam iron, so its structure is not explained in detail here. The water inlet pipe 32 of the high temperature steam forming device 7 is connected with the bottom of the assistant water tank 5, on the jointing area there is a water volume adjusting valve 82 which comprises a knob 83 which is adjustable outside. The water volume adjusting valve 82 can adopt any structure of water volume adjusting valve of existing technology as long as it can adjust the water passing speed. So by regulating the knob 83, one can adjust the water volume which enters the high temperature steam forming device 7, equal to adjusting the forming volume of the high temperature steam.

Referring to FIG. 3, the water inlet valve 81 includes a cylinder valve body 80 which is protruding into the assistant water tank 5 from the bottom of the main water tank 4. The bottom edge of the valve 80 comprises a void 801, the position of the void 801 is lower than the position of the wind blowing mouth 910; the valve 80 comprises a valve hole in the middle of the valve body. in the valve hole there is a valve stopper 811 which tightly fills the valve hole from the bottom to the top. The stopper 811 comprises an up-extending valve stick 812 on the top of the stopper, the valve stick 812 comprising a spring 813 causing the valve stick 812 to move up to tightly fill the valve hole; the main water tank 4 comprise a water inlet 850 on the top of the main water tank, the water inlet 850 comprises a knob cover 85, the bottom of which comprises a connecting rod 84 which extends into the main water tank 4 and is capable of pushing the valve stick 812 downward so as to cause the valve stopper 811 to pull away from the valve hole.

When opening the knob cover 85 to fill water to the main water tank 4 through water inlet 850, forced by the spring 813, the valve stopper 811 tightly fills the valve hole, keeping the water of the main water tank 4 from entering the assistant water tank 5. When the knob cover 85 is set on the water inlet 850 tightly, the main water tank 4 is a sealed space, while the assistant water tank 5 is connected with outside atmosphere, when the water level of the assistant water tank 5 is lower than the void 801 which is set on the bottom edge of the valve 80, the water of the main water tank 4 can flow into the assistant water tank 5 automatically through the valve hole in the middle of the valve 80, when the water level of the assistant water tank 5 rises and submerges the void 801, since the main water tank 4 is sealed, the inside forms minus pressure, the water of the main water tank 4 can't flow down to the assistant water tank 5.

Referring to FIG. 2, the lower end of the steam pipe 31 is connected with the steam outlet pipe 34 which is located in the steam forming device 2, the steam outlet pipe 34 comprises two steam inlets which are respectively connected with the low temperature steam outlet 610 of the atomizing chamber 6 and the high temperature steam outlet pipe 33 of the high temperature steam forming device 7, a mixing steam outlet which is connected with steam outlet pipe 31.

Figure 4:
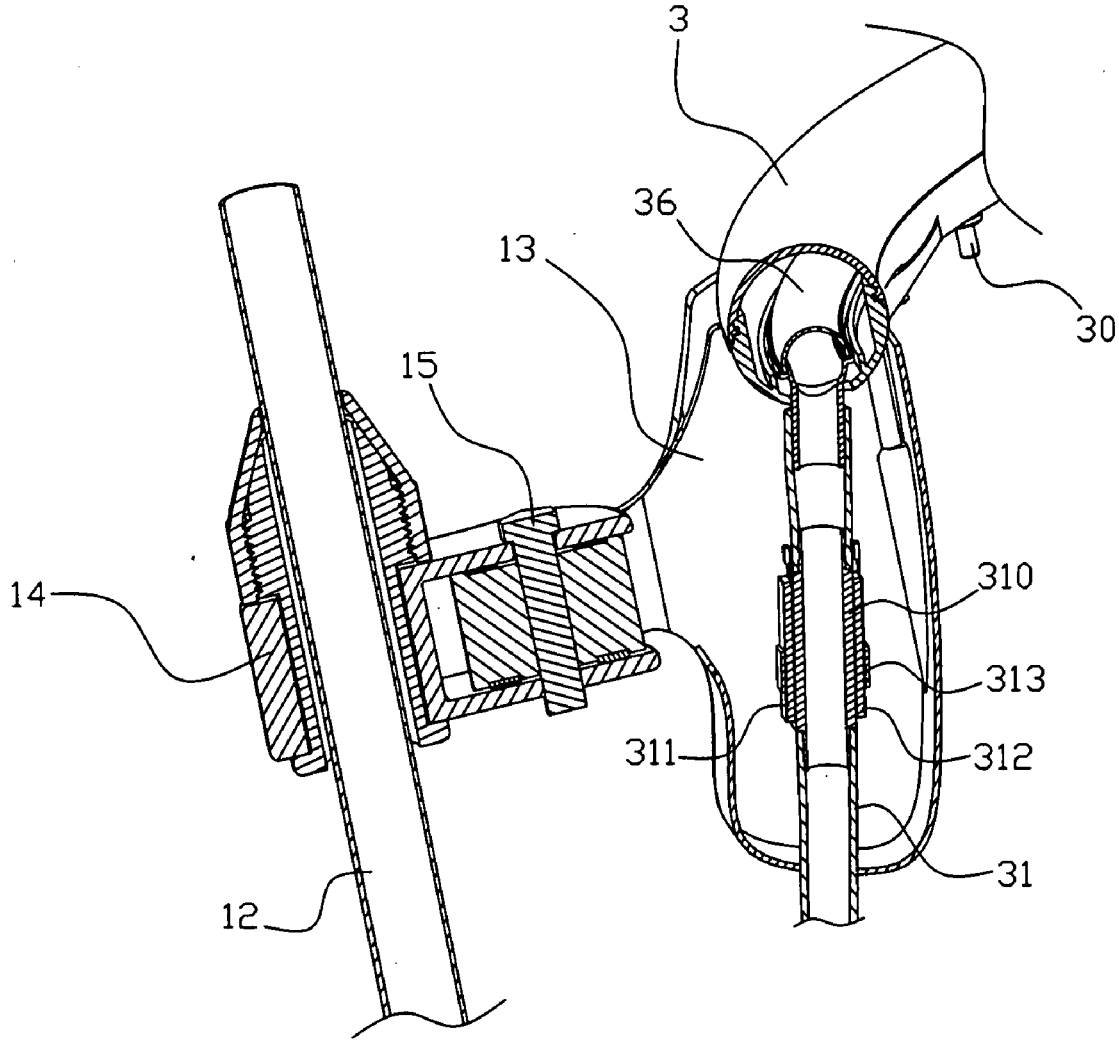
FIG. 4 is one more local sectional view of the first embodiment of the present invention.

Referring to FIG. 4, there is a hollow ring 36 in the steam ejecting ring 3, there are many steam ejecting holes 30 on the bottom of the hollow ring 36, each steam ejecting hole 30 extending down and going out of the steam ejecting ring 36, the steam pipe 31 is connected with the hollow ring 36. The jointing area of the steam pipe 31 and the hollow ring 36 comprise a heating unit. The heating unit comprises: a metal pipe tie-in 310 comprising two ends, the two ends being connected with the steam pipe 31, a PTC heating elements 311, 312 set on the outside wall of the metal pipe tie-in 310 and a thermostat which is connected with the PTC heating elements 311, 312, the thermostat is the existing technology, not shown in FIG. 4, the metal pipe tie-in 310 and the PTC heating elements 311, 312 are located in the said connector 13 by a fixture 313.

Summarizing all the above, if the low temperature vapor formed in the atomizing chamber 6 is mixed with the high temperature steam formed by high temperature steam forming device 7, a vapor with a proper temperature will be generated which is to be applied in treating hair, and the composition of the mixed steam is adjusted by adjusting the proportions of the high temperature steam and the low temperature vapor.

Below is referred to FIGS. 5 to 8 to explain the second embodiment of the present invention.

Figure 5:
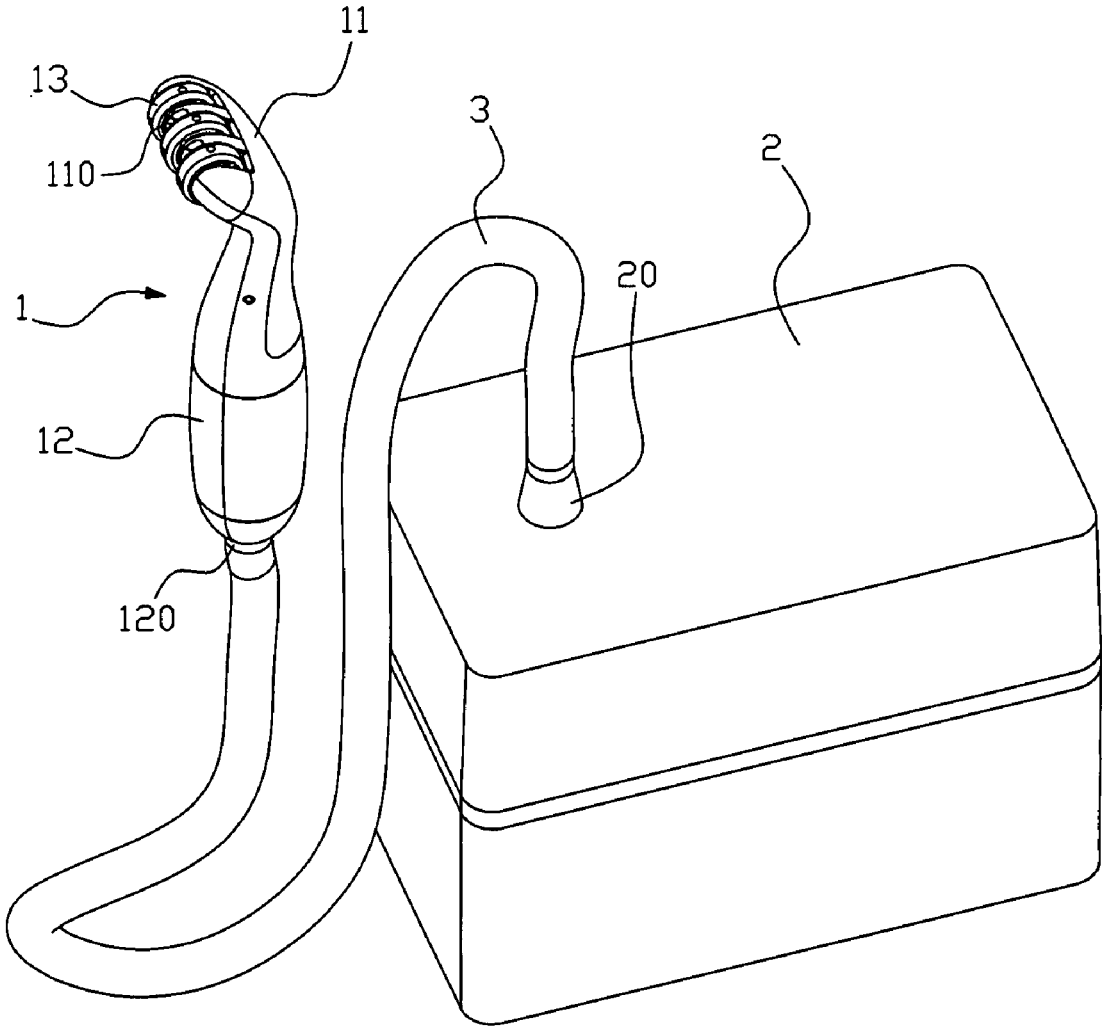
FIG. 5 is the stereogram of the second embodiment of the present invention.

The embodiment is a kind of hand held device to care for the local skin by steam. Referring to FIG. 5, the skin care device using steam comprises a handle 1 and a steam forming device 2. The handle 1 comprises a head 11 and a handle 12 in a single body, there are three massage rollers 13 set on the same axes paratacticly on the head 11, there is a steam outlet 110 between the corresponding two massage rollers, and on the bottom of the handle 12, there is a steam inlet 120; the steam forming device 2 comprises a steam outlet 20 which is connected with the steam inlet 120 of the handle 1 by a steam pipe 3.

Figure 6:
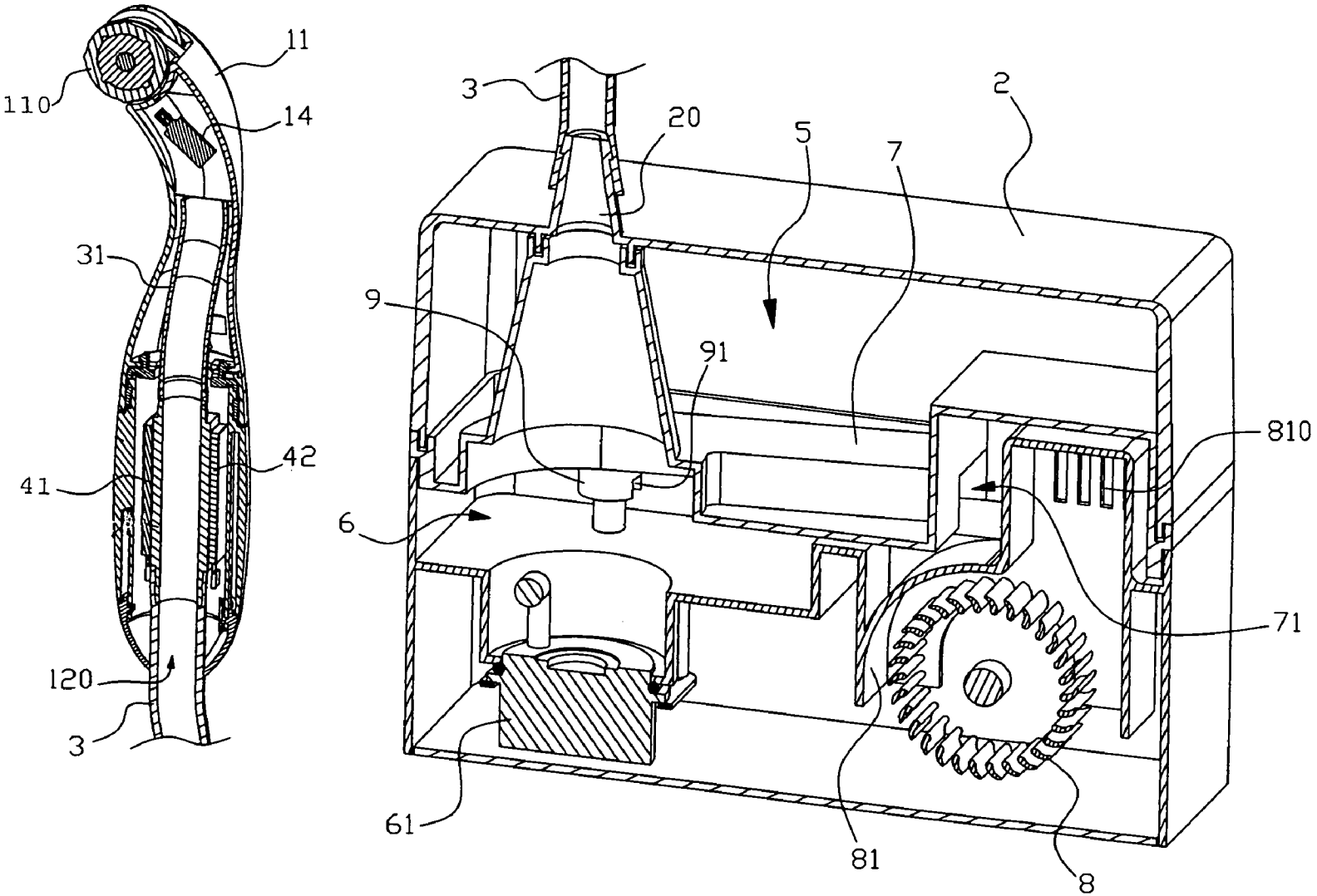
FIG. 6 is a sectional view of the second embodiment of the present invention.

Referring to FIG. 6, in the handle 1 there is a pipe 31 which connects the steam outlet 110 with the steam inlet 120. On pipe 31 there is a heating unit which heats the passing steam, the heating unit is located in the handle 11, comprising a metal pipe tie-in 4 comprising two ends, the two ends being connected with the steam pipe 31. The PTC heating element 41,42 is set on the outside wall of the metal pipe tie-in 4, and a thermostat is connected with the PTC heating elements 41,42. The thermostat is existing technology, not shown in the Figure.

Figure 8:
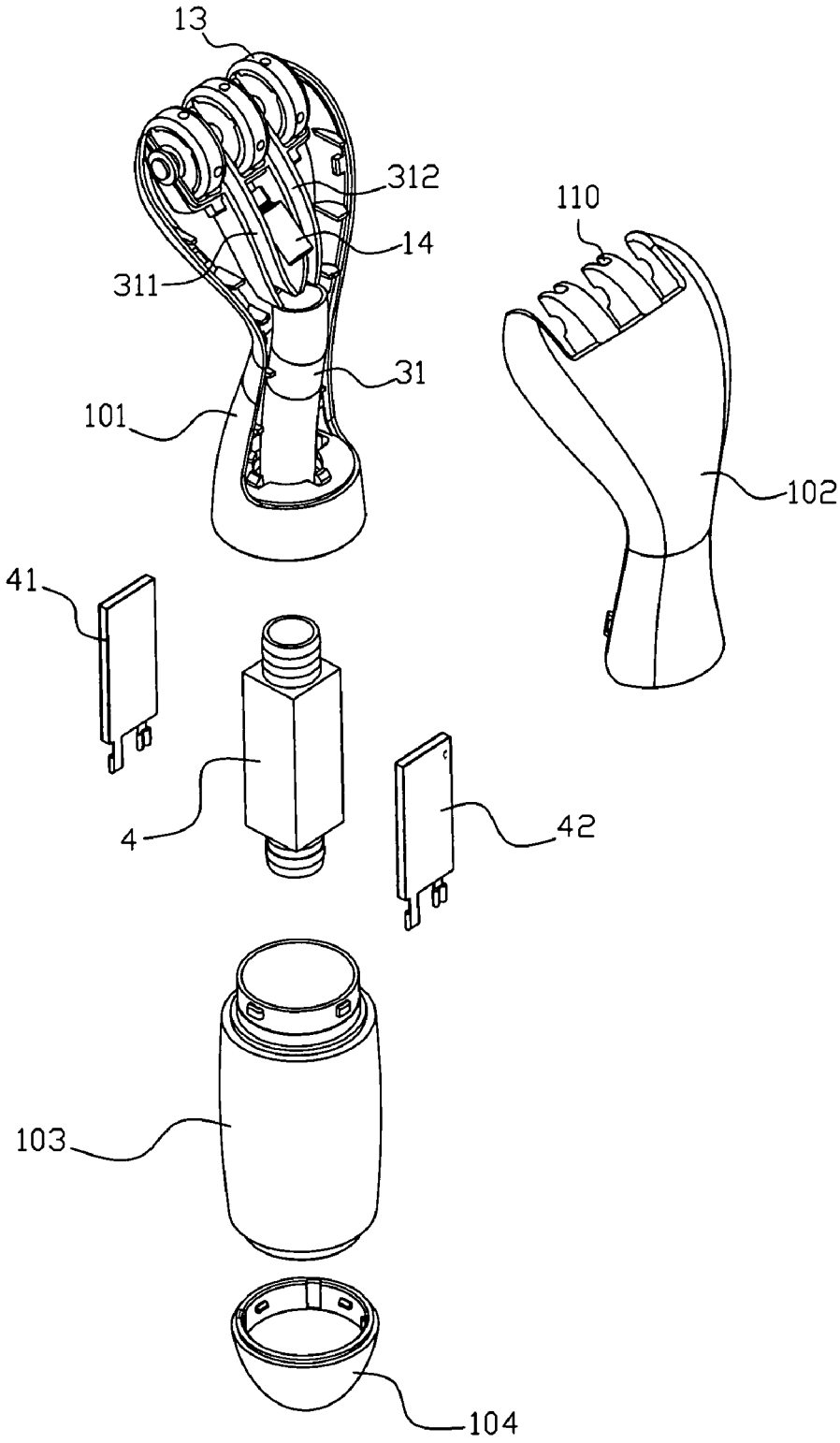
FIG. 8 is the handle exploded view of the second embodiment of the present invention.

Referring to FIG. 8, the shell of the hand held part 1 comprises upper shell 101, upper rear cover 102, handle shell 103 and bottom cover 104 which are connected each other by wedges, upper shell 101, upper rear cover 102 form the said head 11, and the handle shell 103 and the bottom cover 104 form the handle 12. Inside of the head 11, there are two steam channels 311, 312 which are formed by the protruding ribs located in inside wall of the upper shell 101 and upper rear cover 102, the steam channels 311, 312 are connected between the steam pipe 31 and the two steam outlets 110, separating the steam pipe 31 to two branches, so as to make the steam of the steam pipe 31 ejecting from the two steam outlets 110. The metal pipe tie-in 4 and the PTC heating elements 41, 42 form the heating unit which is installed in the handle shell 103, its two ends being connected with the steam pipe 31 and the steam pipe 3 respectively.

There is a vibrator 14 in the head 11 of the hand held part 1 to increase the efficiency of the massage.

Figure 7:
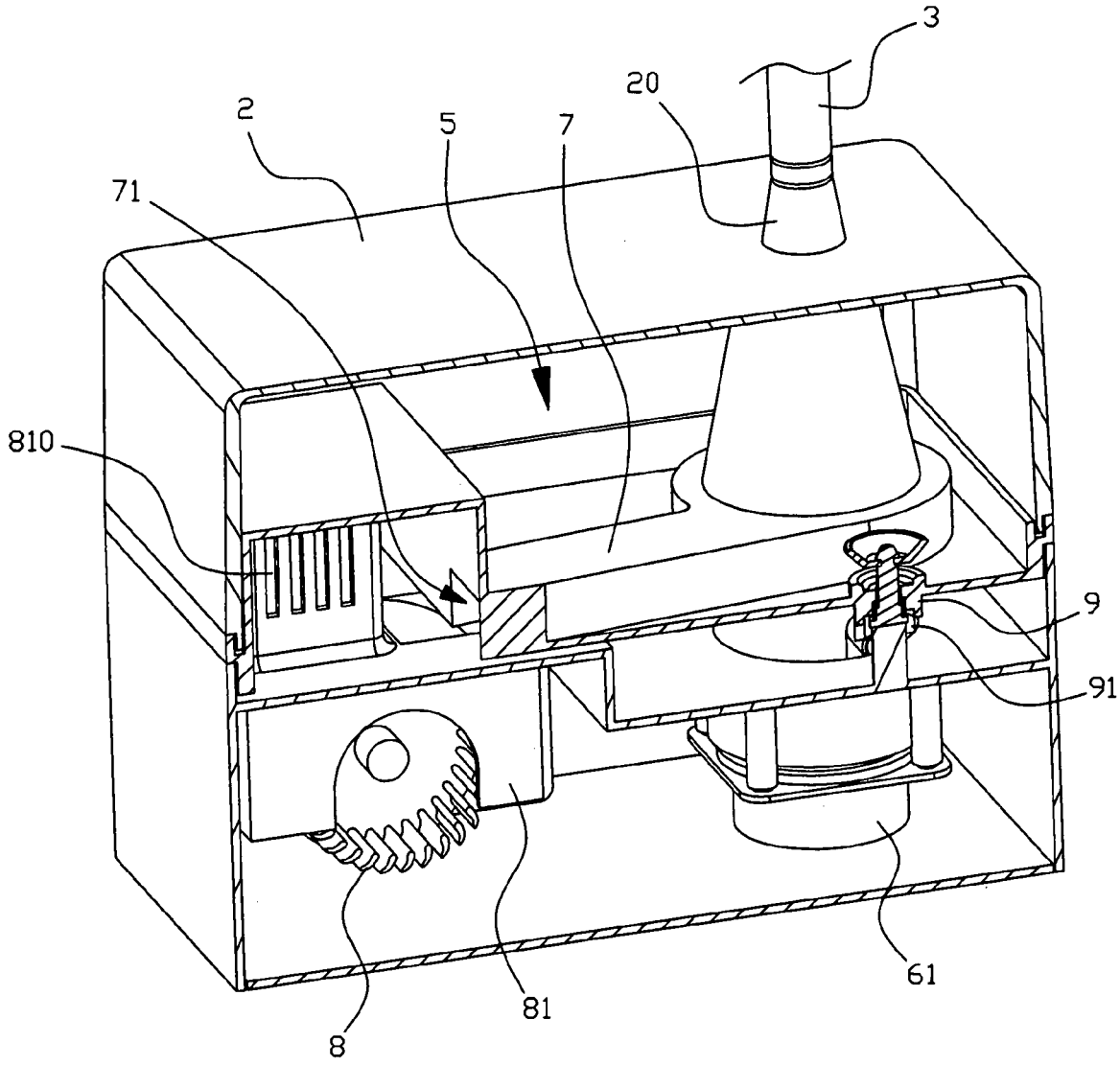
FIG. 7 is a another sectional view of the second embodiment of the present invention.

Referring to FIGS. 6 and 7, these figures are two sectional plane drawings of the steam forming device 2, according to the position of the steam outlet 20 shown in the drawing, one can easily conclude the position and angle of the sectional cutting. The steam forming device 2 comprises the water tank 5, atomizing chamber 6, the water inlet valve 9 set between the water tank 5 and atomizing chamber 6, the atomizer 61 set in the atomizing chamber 6, the steam outlet 20 which is connected with the atomizing chamber 6 by a steam channel 7, the impellor 8 which drives the steam of the atomizing chamber 6 flowing into the steam outlet 20, and a motor which drives the impellor 8, the motor not shown in the drawing, as long as its output shaft is connected with the rotating shaft of the impellor 8. The inside wall of the steam outlet 20 is a cone surface which's smaller end is connected with the said steam pipe 3, the structure is good for the low temperature steam going to the steam pipe 3.

Atomizing chamber 6 is located on the lower side of the water tank 5. The atomizing chamber 6 is connected with outside atmosphere. The water tank 5 is sealed. The said water inlet valve 9, which is set between the water tank 5, and atomizing chamber 6 comprises a valve extending down to the atomizing chamber, the valve comprises a channel which connects the water tank with the atomizing chamber, and there is a void 91 on opening area of lower side of the channel; the inlet 71 position of the steam channel 7 is higher than the void 91, the impellor 8 is located on the lower side of the inlet 71 of the steam channel 7. Outside of the impellor 8, there is a shell 81 which can guide the wind direction, the shape design of the shell 81 causes wind to blow upwards, the upper side of the shell 81 protruding upwards. On the protruding part there is a wind blowing mouth 810, which is connected with the said atomizing chamber 6 and is set near the inlet 71 of the steam channel 7.

The water of the water tank 5 enters atomizing chamber 6 through the water valve 9, being atomized to low temperature vapor by atomizer 61, being driven to passing the said steam channel 7, passing the steam pipe 3 and arriving the hand held part 1. The vapor is then heated by the heating unit in the handle 1 and finally ejected out from the steam outlet 110 of the handle 1 and cooperating with massage roller 13 to care the people's skin. Since the heating unit of the handle 1 is adjustable, the temperature of the ejecting steam can be controlled within the range which is suitable for the skin touching.

The water inlet valve 9 performs the water filling task automaticly according to the followings: When the water level of the atomizing chamber 6 is lower than the void 91 and the channel is kept smoothly, the water of the water tank 5 will flow into atomizing chamber 6 through the water inlet valve 9. When the water level of the atomizing chamber 6 is higher than the void 91, since the water tank 5 is sealed, the inside of the chamber will generate negative pressure, and the water of the water tank 5 cannot flow into atomizing chamber 6.

The third embodiment is different from the second embodiment. The output part is a massage belt, on the inside surface of which there are several massage protruding points and a plurality of steam outlets which are respectively set between the corresponding massage protruding points. The heating unit is set on the outside surface of the massage belt, the heating unit comprising: a metal pipe tie-in, the two ends of which are connected with the steam pipe, a PTC heating element which is set on the outside wall of the metal pipe tie-in, and a thermostat which is connected with the PTC heating element. The atomization device and water tank are in a single body structure which is connected with the output part by steam pipe.

The output part of the present invention can also be other hairdressing tools, such as steam face shelter.

The above described features are only embodiments of the present invention. The design and idea of the present invention is not limited to these features, and equivalent changes and modifications based on the contents of the present invention fall within the scope of the present invention.

INDUSTRY PRACTICABILITY

The present invention of the device and method for forming warm vapor is using the atomization device to cause the water to become low temperature vapor and then mixing the low temperature vapor with high temperature steam, or heating the low temperature vapor so as to generate desired temperature vapor, the present invention structure is simple, its application is convenient, and it has great practicability.

The invention claimed is:

1. A device for forming warm vapor, comprising:

(a) an atomization device comprising:

a atomizing chamber comprising a low temperature vapor outlet, a atomizer which is located in the atomizing chamber to make the water become a low temperature vapor, and a impeller driving the low temperature vapor of the atomizing chamber into the outlet;

(b) a high temperature steam forming device for producing high temperature steam comprising a high temperature steam outlet;

(c) a steam outlet pipe, comprising:

two steam intakes which are respectively connected with the low temperature vapor outlet of the atomizing chamber and high temperature steam outlet of the high temperature steam forming device, and a mixing steam outlet; and (d) a water tank for supplying needed water for the atomization device and the high temperature steam forming device, wherein a stream of water from the water tank passes through the atomizing device to generate a low temperature vapor, wherein another stream of water from the water tank passes through the steam forming device to generate a high temperature steam, wherein the high temperature steam and the low temperature vapor are mixed by the steam outlet pipe, and wherein the composition of the mixed steam is adjusted by adjusting the proportions of the high temperature steam and the low temperature vapor.

2. The steam forming device of claim 1, the water tank comprising:

a main water tank located on the upper side, an assistant water tank located on the lower side, a water inlet valve between the main water tank and the assistant water tank, and a wind guiding shell comprising a wind blowing mouth, wherein the atomizing chamber is set on one side of and connected with the assistant;

wherein the low temperature steam outlet is set on the top of the atomizing chamber;

wherein the wind guiding shell is set outside of the impeller, the wind blowing mouth of the wind guiding shell facing the bottom of the low temperature steam outlet; and wherein the water inlet pipe of the high temperature steam forming device is connected with the bottom of the assistant water tank where a water volume adjusting valve being set on the connecting area and the water volume adjusting valve comprises a knob which is adjustable outside.

3. The steam forming device of claim 2, wherein the water inlet valve includes a cylinder valve body which is protruding into the assistant water tank from the bottom of the main water tank, wherein the bottom edge of the valve comprises a void, the position of the void being lower than the position of the wind blowing mouth;

wherein the valve comprises a valve hole in the middle of the valve body;

wherein in the valve hole there is a valve stopper which tightly fills the valve hole from the bottom to the top;

wherein the stopper comprises an up-extending valve stick on the top of the stopper, the valve stick comprising a spring causing the valve stick to move up to tightly fill the valve hole; and wherein the main water tank comprises a water inlet on the top of the main water tank, the water inlet comprises a knob cover, the bottom of which comprises a connecting rod which extends into the main water tank and is capable of pushing the valve stick downward so as to cause the valve stopper to pull away from the valve hole.

4. The steam forming device of claim 1, wherein the mixing steam outlet of the steam guiding output pipe is connected with a hollow ring by a steam pipe, wherein on the bottom of the hollow ring there are many steam ejecting holes along the circumference, and wherein the hollow ring is set on a rack.

5. The steam forming device of claim 4, wherein there is a heating unit located on the jointing position of the steam pipe and the hollow ring, wherein the heating unit comprises:

a metal pipe tie-in comprising two ends, the two ends being connected with the steam pipe, a PTC heating element set on the outside wall of the metal pipe tie-in, and a thermostat which is connected with the PTC heating element.

6. An adjustable temperature steam forming device, comprising:

(a) an atomization device comprising:

a atomizing chamber, an atomizer located in the atomizing chamber for causing water to become to low temperature vapor, and a impeller for driving the low temperature vapor in the atomizing chamber to flow toward outlet;

(b) a water tank for supplying water to the atomization device;

(c) an output part comprising a handling part, comprising:

a steam inlet on the handling part, at least one steam outlet, and a pipe connecting the steam inlet and the at least one steam outlet, the pipe comprising an adjustable temperature heating unit on the pipe; and (d) a steam pipe which connects the steam inlet on the handling part with the low temperature steam outlet of the atomizing chamber, wherein the water in the water tank is caused to form a low temperature vapor by the atomization device, wherein the temperature of a low temperature vapor is increased by the heating unit on the handling part, and wherein the temperature of the vapor is adjusted by adjusting the heating unit.

7. The steam forming device of claim 6, wherein the output part is a handling part, the handling part comprising a head and a handle in a single body, the head comprising a plurality of massage rollers which are paratacticly set on the head, wherein the handling part comprises a plurality of steam outlets which are respectively set between the corresponding massage rollers, wherein the steam inlet on the handling part is set on the end of the handle; and wherein the heating element is set inside the handle, the heating element comprising a metal pipe tie-in comprising two ends, the two ends being connected with the steam pipe, a PTC heating element set on the outside wall of the metal pipe tie-in, and a thermostat which is connected with the PTC heating element.

8. The steam forming device of claim 6, wherein the atomizing chamber is located on the lower side of the water tank, the atomizing chamber being connected with outside atmosphere, wherein the water tank is sealed, wherein there is a water inlet valve between the water tank and the atomizing chamber, the water inlet valve including a cylinder valve body which is extending to the atomizing chamber where the inside of the valve body comprises a channel which connects the water tank with the atomizing chamber, and where the lower end of the valve body comprises a void, wherein the atomizing chamber is connected with steam outlet by a steam channel, the position of the inlet of the steam channel being higher than the void of the water inlet valve, wherein on the outside of the impeller there is a wind guiding shell, the wind guiding shell comprising a wind blowing mouth which is connected with the atomizing chamber and is near the inlet of the steam channel.

9. The steam forming device of claim 6, wherein the output part is a massage belt, on the inside surface of which there are several massage protruding points and a plurality of steam outlets which are respectively set between the corresponding massage protruding points, wherein the heating unit is set on outside surface of the massage belt, the heating unit comprising:

a metal pipe tie-in, the two ends of which are connected with the steam pipe, a PTC heating element which is set on the outside wall of the metal pipe tie-in, and a thermostat which is connected with the PTC heating element.

10. The steam forming device of claim 6, wherein the atomization device and the water tank are a single body structure which is connected with the output part by steam pipe.

11. The adjustable temperature steam forming device of claim 7, wherein the atomizing chamber is located on the lower side of the water tank, the atomizing chamber being connected with outside atmosphere, wherein the water tank is sealed, wherein there is a water inlet valve between the water tank and the atomizing chamber, the water inlet valve including a cylinder valve body which is extending to the atomizing chamber where the inside of the valve body comprises a channel which connects the water tank with the atomizing chamber, and where the lower end of the valve body comprises a void, wherein the atomizing chamber is connected with steam outlet by a steam channel, the position of the inlet of the steam channel being higher than the void of the water inlet valve, wherein on the outside of the impeller there is a wind guiding shell, the wind guiding shell comprising a wind blowing mouth which is connected with the atomizing chamber and is near the inlet of the steam channel.

* * * * *